US005312044A

United States Patent [19]

Eaton

[11] Patent Number: 5,312,044

[45] Date of Patent: May 17, 1994

[54] PRESSURE CLEANING METHOD AND APPARATUS

[76] Inventor: James O. Eaton, 22 Plantation Dr. NE., Cartersville, Ga. 30120

[21] Appl. No.: 997,858

[22] Filed: Dec. 29, 1992

[51] Int. Cl.[5] ..... B05B 13/00

[52] U.S. Cl. ..... 239/225.1; 239/289; 239/DIG. 6; 134/181

[58] Field of Search ..... 134/172, 180, 181; 239/237, 239, 240, 263.3, 263.2, 242, 225.1, 289, DIG. 6; 15/320

[56] References Cited

U.S. PATENT DOCUMENTS

| | | | |
|---|---|---|---|
| 1,498,255 | 6/1924 | Winchester | 15/320 |
| 2,223,963 | 12/1940 | Nadig | 134/181 X |
| 2,878,633 | 3/1959 | Mullin | 239/DIG. 6 |
| 2,939,636 | 6/1960 | Mullin | 239/263.2 |
| 3,534,579 | 8/1970 | Robra | 72/377 |
| 3,537,333 | 11/1970 | Seifert et al. | 74/597 |
| 3,659,125 | 4/1972 | Basel | 239/225.1 |
| 3,857,515 | 12/1974 | Zennie | 239/289 |
| 4,000,538 | 1/1977 | Tissier | 15/320 |
| 4,107,816 | 8/1978 | Matthews | 239/225.1 |
| 4,191,590 | 3/1980 | Sundheim | 15/322 X |
| 4,264,999 | 5/1981 | Monson | 15/320 |
| 4,295,243 | 10/1981 | King | 15/320 |

FOREIGN PATENT DOCUMENTS

| | | | |
|---|---|---|---|
| 660580 | 3/1938 | Fed. Rep. of Germany | 239/225 |

OTHER PUBLICATIONS

"Turbo Twister" sales brochure.

Supplemental "Turbo Twister" sales paperwork.

Have Gum, Will Travel the Sidewalks; article copied from The Philadelphia Inquirer; used as supplemental "Turbo Twister" sales paperwork.

*Primary Examiner*—Frankie L. Stinson

*Attorney, Agent, or Firm*—Louis T. Isaf

[57] ABSTRACT

A method and apparatus for pressure cleaning, wherein fluid from a source of pressurized fluid is injected into, passes through, and is ejected from the crankshaft of a motor toward a surface that is to be cleaned. The crankshaft defines a crankshaft passage therethrough and has a crankshaft inlet end into which the fluid is injected and a crankshaft outlet end out of which the fluid flows. A distribution assembly is attached to the crankshaft outlet end and the fluid flowing out of the crankshaft outlet end flows through the distribution assembly and is discharged therefrom. The crankshaft rotates and causes the distribution assembly to rotate. The rotation and orientation of the distribution assembly causes the velocity of the fluid discharged from the distribution assembly to be greater than the velocity that would be achieved solely due to the pressure differential between the source of pressurized fluid and the environment at the outlet of the distribution assembly.

9 Claims, 3 Drawing Sheets

PRESSURE CLEANING METHOD AND APPARATUS

BACKGROUND OF THE INVENTION

The present invention relates generally to the field of pressure cleaning, and, in its most preferred embodiments, to the field of rotary pressure cleaners.

Pressure cleaners, and the manner of using them to clean durable surfaces, are well known. Pressure cleaners are used, in conjunction with a source of pressurized fluid, to cause a high velocity stream of fluid to impact upon the surface to be cleaned. The impact of the fluid upon the surface to be cleaned has a cleaning effect. Pressure cleaners are very effective at lifting stubborn dirt and stains from a variety of surfaces. A simple "wand" pressure cleaner consists of a nozzle or tube that is connected to the source of pressurized fluid by a hose. Due to the pressure differential between the source of pressurized fluid and the environment at the nozzle or tube outlet, fluid passes from the source of pressurized fluid, through the hose, and out of the nozzle or tube at a velocity that is sufficient for cleaning.

A rotary pressure cleaner is an advanced type of pressure cleaner. Rotary pressure cleaners are similar to "wand" pressure cleaners in that they also include a nozzle, or nozzles, that are in fluid communication with a source of pressurized fluid. However, the nozzles of rotary pressure cleaners are rotated about a central point.

A typical rotary pressure cleaner includes a deck that is supported by wheels. A vertical tube that is in fluid communication with a source of pressurized fluid passes through the deck. The vertical tube is attached to the middle portion of a horizontal tube that is positioned below the deck, and the vertical tube is in fluid communication with the horizontal tube. The horizontal tube has nozzles connected thereto at a distance away from the middle portion of the horizontal tube. The nozzles are oriented at least partially downward such that fluid flows from the source of pressurized fluid, through the vertical tube, into the horizontal tube, through and out of the nozzles toward a surface located below the rotary pressure cleaner. The nozzles are set into motion by a motor that is mounted to the deck. The rotational output of the motor is translated to the nozzles by a belt that connects the motor output shaft to a pulley that drives the horizontal tube.

There are several potential problems associated with the typical rotary pressure cleaner. These problems have to do with the manner in which the rotational output of the motor is translated to the nozzles. As is specified above, several components are used to translate the rotational output of the motor to the nozzles. These several components add to the weight and cost of the rotary pressure cleaner. These several components also add to the amount of maintenance that must potentially be done to the rotary pressure cleaner.

There is, therefore, a need in the industry for a method and an apparatus which solve these and other related, and unrelated, problems.

SUMMARY OF THE INVENTION

Briefly described, the present invention includes, in its most preferred embodiment, a new pressure cleaner, referred to herein as a rotary pressure cleaner. According to the preferred embodiment of the present invention, the rotary pressure cleaner includes a special gasoline powered engine mounted to a wheeled chassis. The engine includes, at least, a crankshaft defining a crankshaft passage therethrough. The crankshaft has a crankshaft inlet end defining a crankshaft inlet port that is in fluid communication with the crankshaft passage. The crankshaft also has a crankshaft outlet end that depends vertically from the engine and passes through the wheeled chassis such that the crankshaft can rotate relative to the wheeled chassis. The crankshaft outlet end defines a crankshaft outlet port that is in fluid communication with the crankshaft passage.

According to the preferred embodiment of the present invention, the rotary pressure cleaner further includes, at least, an injection assembly attached to the crankshaft inlet end. The injection assembly includes an injection housing that defines an injection cavity that is in fluid communication with the crankshaft inlet port. The injection cavity is also in fluid communication with a source of pressurized fluid by way of an injection hose. Fluid flows from the source of pressurized fluid, through the injection assembly, and into the crankshaft inlet port.

According to the preferred embodiment of the present invention, the rotary pressure cleaner further includes, at least, a distribution assembly attached to the crankshaft outlet end. The distribution assembly includes a horizontal distribution tube that is affixed to the crankshaft outlet end and in fluid communication with the crankshaft outlet port. Nozzles are attached to, and in fluid communication with, the distribution tube at a radial distance from the crankshaft outlet end. The nozzles are pointed at least partially downward so that fluid flows from the crankshaft outlet port, through the distribution tube, and out of the nozzles toward a surface oriented below the wheeled chassis.

According to the preferred embodiment of the present invention, when the engine of the rotary pressure cleaner is operated, the nozzles of the rotary pressure cleaner are rotated about the crankshaft outlet end. In addition to being pointed at least partially downward, the nozzles are also pointed, at least partially, in the direction of rotation. Therefore, the velocity of the fluid exiting the nozzles is increased above the velocity that would be achieved solely due to the pressure differential between the source of pressurized fluid and the environment at the nozzle outlet. Nozzle rotation also facilitates the application of fluid over a broad surface area. The wheeled chassis is pushed across the surface that is to be cleaned in order to clean a broader surface area.

The scope of the present invention includes rotary pressure cleaners of various alternate embodiments. For example, according to one alternate embodiment of the present invention, an electric motor is used in place of the gasoline powered engine.

It is therefore an object of the present invention to provide a new method and apparatus for pressure cleaning.

Another object of the present invention is to provide an improved method and apparatus for increasing the velocity at which fluid is discharged from a pressure cleaner.

Yet another object of the present invention is to provide an improved rotary pressure cleaner and a method of using the improved rotary pressure cleaner.

Still another object of the present invention is to provide a rotary pressure cleaner that utilizes an engine with a crankshaft having a passage therethrough, and a method of using the rotary pressure cleaner, wherein the fluid that is discharged from the pressure cleaner passes through the passage defined by the crankshaft.

Still another object of the present invention is to provide a rotary pressure cleaner that utilizes a motor with an armature shaft defining a passage therethrough, wherein the fluid that is discharged from the pressure cleaner passes through the passage defined by the armature shaft.

Other objects, features and advantages of the present invention will become apparent upon reading and understanding this specification, taken in conjunction with the accompanying drawings.

DETAILED DESCRIPTION OF THE PREFERRED EMBODIMENT

Figure 1:
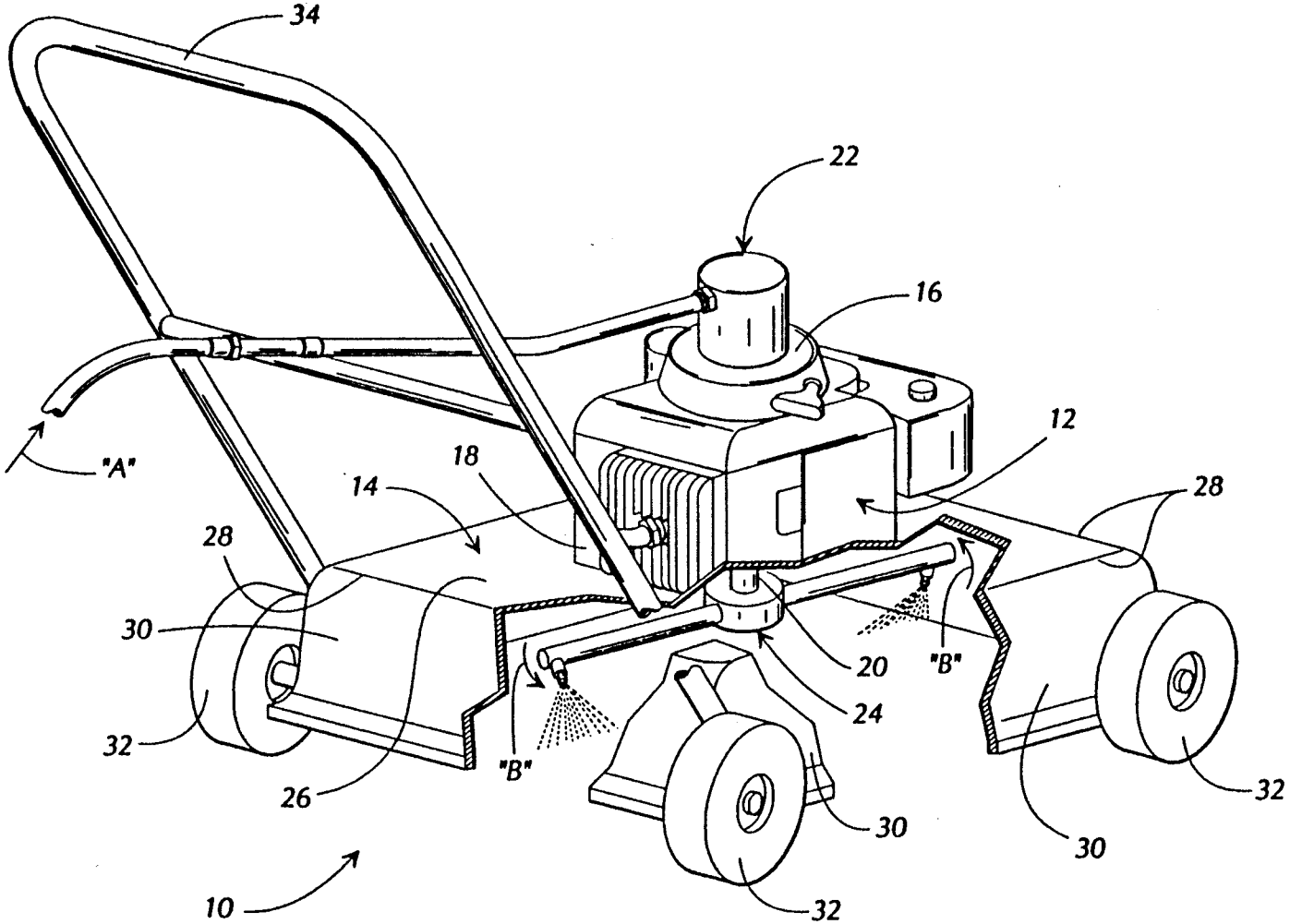
FIG. 1 is a perspective, cut-away view of a rotary pressure cleaner in accordance with the preferred embodiment of the present invention.

Referring now in greater detail to the drawings, in which like numerals represent like components throughout the several views, FIG. 1 shows a perspective view of a rotary pressure cleaner 10, in accordance with a preferred embodiment of the present invention. The rotary pressure cleaner 10 includes, at least, a gasoline powered engine 12 and a wheeled chassis 14, similar to the chassis of a lawn mower. The engine 12 includes an engine top 16, and an engine base 18 which is mounted to the wheeled chassis 14. The engine 12 further includes a crankshaft 20, a portion of which depends from the engine base 18 and passes through the wheeled chassis 14 in a manner that allows the crankshaft 20 to rotate relative to the wheeled chassis 14. The rotary pressure cleaner 10 further includes an injection assembly 22 mounted to the crankshaft 20 at the engine top 16 and a distribution assembly 24 mounted to the crankshaft 20 below the wheeled chassis 14.

The wheeled chassis 14 includes, at least, a deck 26 that includes a deck periphery 28. The wheeled chassis 14 further includes, at least, a skirt 30 that depends from the deck periphery 28, a plurality of wheels 32 rotatably connected to the skirt 30, and a handle 34 that is connected to the skirt 30.

Figure 2:
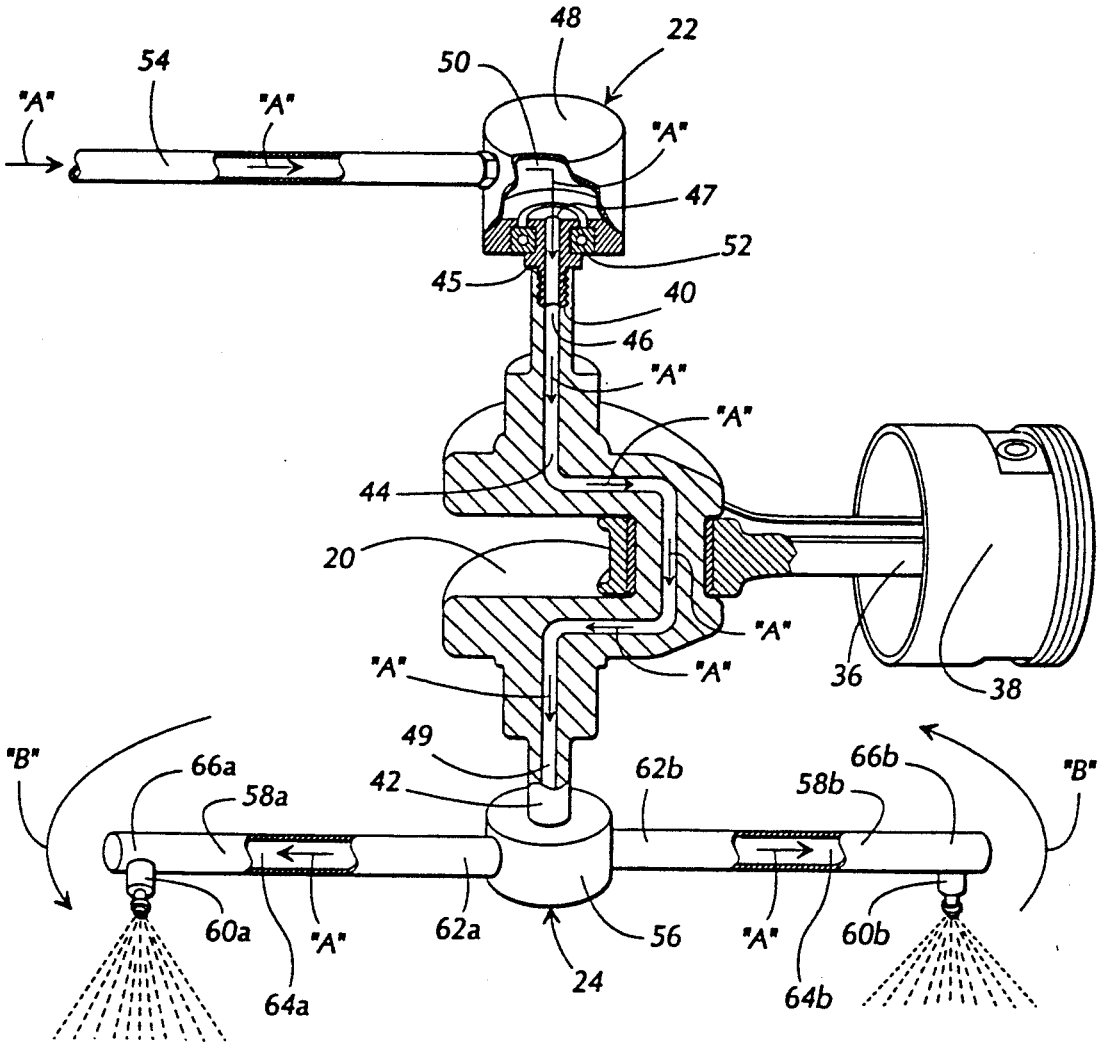
FIG. 2 is a perspective, cut-away, cross-sectional view of a portion of the rotary pressure cleaner of FIG. 1.

Referring to FIG. 2, which is a perspective, cut-away, cross-sectional view of a portion of the rotary pressure cleaner 10 of FIG. 1, the crankshaft 20 is cross-sectioned. Also, the injection assembly 22 is partially cut-away and cross sectioned, and the distribution assembly 24 is partially cross-sectioned. Also seen is a conventional connecting rod 36 and conventional piston 38 that are part of the engine 12.

According to the preferred embodiment of the present invention, the crankshaft 20 includes, at least, a crankshaft inlet end 40, defining a crankshaft inlet port 46, at the engine top 16 (see FIG. 1) and a crankshaft outlet end 42, defining a crankshaft outlet port 49, that depends from the engine bottom 18, and passes through and can rotate relative to the deck 26 (see FIG. 1). The crankshaft 20 defines a crankshaft passage 44 that is disposed between the crankshaft inlet end 40 and the crankshaft outlet end 42 and is in fluid communication with the crankshaft inlet port 46 and the crankshaft outlet port 49.

According to the preferred embodiment of the present invention, the injection assembly 22 is attached to the crankshaft inlet end 40. The injection assembly 22 includes, at least, a crankshaft extension 45 that is connected to the crankshaft inlet end 40 and is accessible at the engine top 16 (see FIG. 1). The crankshaft extension 45 defines an extension passage 47 therethrough that is in fluid communication with the crankshaft inlet port 46. The injection assembly 22 further includes, at least, an injection housing 48 that defines an injection cavity 50 therein that is in fluid communication with the extension passage 47. The injection housing 48 is connected to the crankshaft extension 45 by, at least, a rotary bearing 52 disposed between the crankshaft extension 45 and the injection housing 48. The rotary bearing 52 allows the crankshaft 20 and crankshaft extension 45 to rotate relative to the injection housing 48 and is, at least, substantially leak-tight. The injection cavity 50 is in fluid communication with a conventional source of pressurized fluid (not seen) by way of an injection hose 54.

According to the preferred embodiment of the present invention, the distribution assembly 24 includes a distribution housing 56, a pair of distribution tubes 58*a,b*, and a pair of nozzles 60*a,b*. The distribution housing 56 is attached to the crankshaft outlet end 42 and defines a distribution cavity (not seen) that is in fluid communication with the crankshaft outlet port 49. The distribution tubes 58*a,b* have upstream ends 62*a,b* connected to the distribution housing 56. The distribution tubes 58*a,b* extend radially from the distribution housing 56, define tube cavities 64*a,b* that are in fluid communication with the distribution cavity, and terminate at downstream ends 66*a,b*. Nozzle 60*a,b* are attached to each distribution tube 58*a,b* near the downstream end 66*a,b*. The nozzles 60*a,b* are in fluid communication with the tube cavities 64*a,b*, and are pointed at least partially downward and at least partially in the direction of crankshaft 20 rotation, as will be discussed below.

Referring back to both FIGS. 1 and 2, one process of manufacturing and assembling the rotary pressure cleaner 10 of the preferred embodiment of the present invention involves, first, obtaining a conventional lawn mower. The blade is removed from the crankshaft 20 and the crankshaft 20 is removed from the engine 12. Then the crankshaft passage 44 is bored through the crankshaft 20. The curved shape of the crankshaft passage 44 is achieved by boring several different cavities into the crankshaft 20 so that they interconnect, and plugging those portions of the cavities that do not contribute to the crankshaft passage 44 as it is shown in FIG. 2. The crankshaft 20 is re-balanced once the crankshaft passage 44 is in-place, balancing occurring while the crankshaft passage 44 is filled with fluid. Once the crankshaft 20 is balanced, the engine 12 is reassembled.

The injection assembly 22 is fabricated before it is attached to the rotary pressure cleaner 10. First, the crankshaft extension 45 is fabricated, with the extension passage 47 therethrough, from metal. Then injection housing 48 is fabricated from metal. Subsequently, a rotary bearing 52, that provides the characteristics described above, is mated to the crankshaft extension 45, the injection housing 48 is mated to the rotary bearing 52, and the injection hose 54 is attached to the injection housing 48. Once the injection assembly 22 is assembled, it is attached to the crankshaft inlet end; the crankshaft extension 45 is spliced to the crankshaft inlet end 40, for example, by threading the crankshaft extension 45 into the crankshaft inlet end 40.

Prior to attaching the distribution assembly 24 to the rotary pressure cleaner 10, the distribution housing 56 is fabricated from metal, and the distribution tubes 58*a,b* are cut from a rigid piece of metal tubing. The distribution tubes 58*a,b* are cut to a length that allows them to fit under the wheeled chassis 14. Then the distribution housing 56 is mated to the crankshaft outlet end 42, the upstream end 62*a,b* of the distribution tubes 58*a,b* are mated to the distribution housing 56, and the downstream end 66*a,b* of the distribution tubes 58*a,b* are plugged (plugs are not seen). A hole (not seen) is bored through each of the distribution tubes 58*a,b* at the position that the nozzles 60*a,b* are attached, and the nozzles are attached to the distribution tubes 58*a,b* such that they are oriented s is discussed above.

Referring to both FIGS. 1 and 2, and regarding the preferred method of using the rotary pressure cleaner 10, the injection hose 54 is connected to a source of pressurized fluid. As a result, fluid from the source of pressurized fluid flows, as is indicated by directional arrows "A", through the injection assembly 22, through the crankshaft passage 44, through the distribution assembly 24, and out of the nozzles 60*a,b* toward the surface that the rotary pressure cleaner 10 is resting upon. The engine 12 causes rotation of the distribution assembly 24 in the direction indicated by arrows "B". As is discussed above, the nozzles 60*a,b* are pointed, at least partially, in the direction of rotation. Therefore, the velocity of the fluid exiting the nozzles 60*a,b* is increased above the velocity that would be achieved solely due to the pressure differential between the source of pressurized fluid and the environment outside of the nozzles 60*a,b*. The fluid that exits the nozzles 60*a,b* impacts upon and cleanses the surface that the rotary pressure cleaner 10 is resting upon. When the handle 34 of the rotary pressure cleaner 10 is pushed, the plurality of wheels 32 allow the rotary pressure cleaner 10 to travel across the surface to be cleaned, whereby a large surface area is cleaned.

In accordance with alternate embodiments of the present invention, differing numbers of, different configurations of, and different types of nozzles 60*a,b* are incorporated into the distribution assembly 24. The ideal nozzle 60*a,b* configuration is dependent upon a variety of factors, which include, but are not limited to, the type of cleaning that is to be done, the type of fluid being utilized, the temperature of the fluid being utilized, and the type of surface being cleaned.

In accordance with another embodiment of the present invention, a specially fabricated crankshaft is utilized. The special crankshaft is formed, for example, by pouring molten metal into an appropriate mold, with a mold core therein, to form a crankshaft passage.

In accordance with another embodiment of the present invention, a crankshaft extension 45 is not utilized. Rather, a specially fabricated crankshaft is utilized. The special crankshaft is longer than the crankshaft 20 and is formed, for example, by pouring molten metal into an appropriate mold, with a mold core therein, to form a crankshaft passage. In this alternate embodiment, the rotary bearing 52 is applied directly to the crankshaft.

In accordance with another embodiment of the present invention, the distribution assembly 24 can be removed from the rotary pressure cleaner 10 and replaced with a blade to allow the rotary pressure cleaner to be used as a lawn mower.

Figure 3:
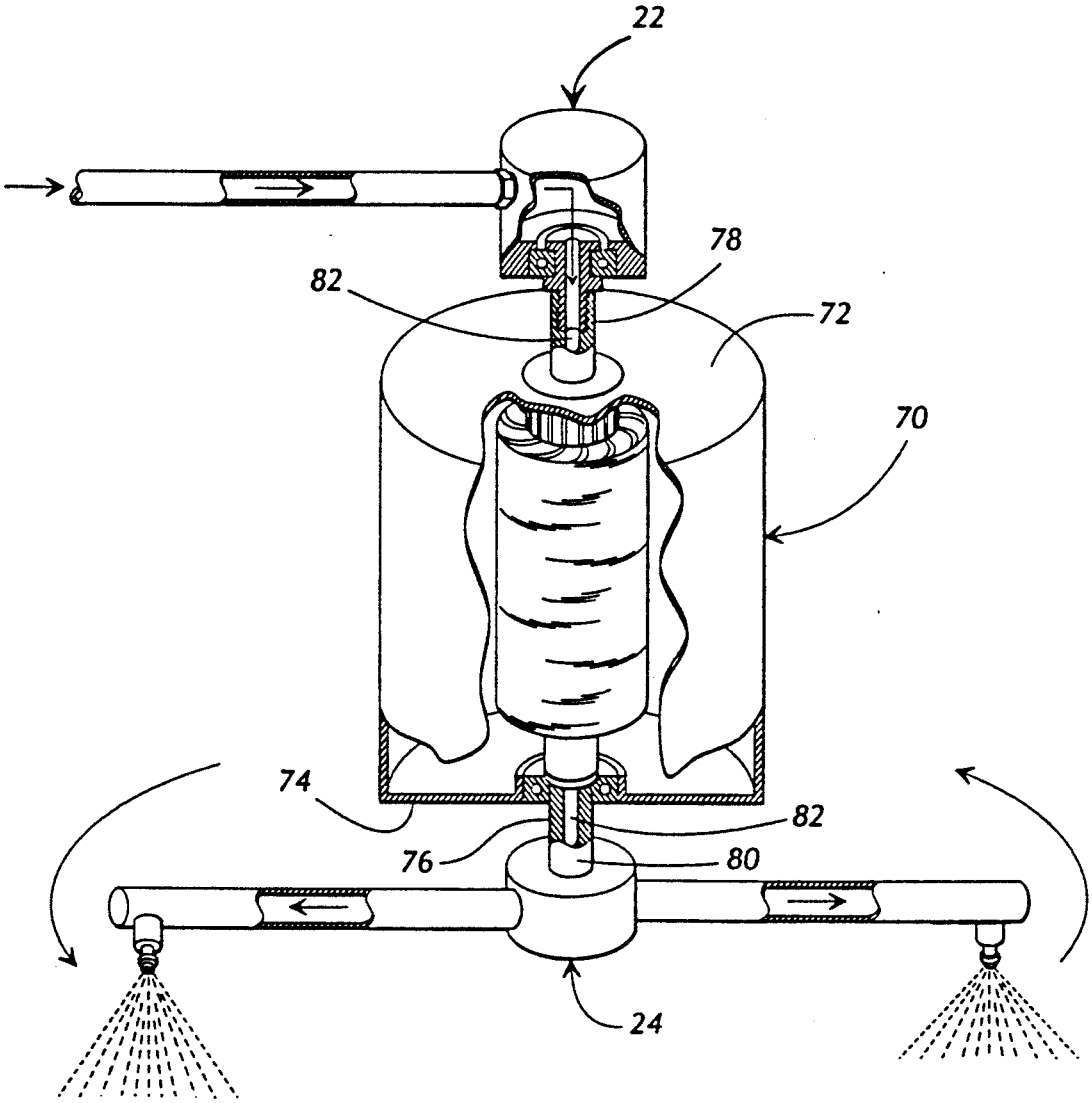
FIG. 3 is a perspective, cut-away, cross-sectional view of a portion of a rotary pressure cleaner in accordance with an alternate embodiment of the present invention.

In accordance with another alternate embodiment of the present invention, an electric motor 70 is utilized in place of the gasoline engine 12. FIG. 3 is a perspective, cut-away, cross-sectional view of a portion of a rotary pressure cleaner in accordance with the electric motor alternate embodiment. The electric motor 70 includes, at least, an motor top 72 and an motor base 74. The electric motor 70 further includes an armature shaft 76, which rotates, having an shaft inlet end 78 and a shaft outlet end 80. The armature shaft defines an armature shaft cavity 82 that extends from the shaft inlet end 78 to the shaft outlet end 80. An injection assembly 22 is attached to the shaft inlet end 78, and a distribution assembly 24 is attached to the shaft outlet end 80 in a manner that allows the electric motor alternate embodiment to function in a manner that is substantially similar to the manner in which the rotary pressure cleaner 10 of the preferred embodiment of the present invention operates with the exception that the electric motor 70 is powered by electricity and functions as a conventional electric motor.

Whereas this invention has been described in detail with particular reference to preferred embodiments and alternate embodiments thereof, it will be understood that variations and modifications can be effected within the spirit and scope of the invention, as described herein before and as defined in the appended claims.

I claim:

1. A pressure cleaning apparatus for applying fluid under pressure, provided from a source of pressurized fluid, to a durable surface, wherein said pressure cleaning apparatus comprises:

an engine including, at least, a crankshaft including, at least, a crankshaft first end and a crankshaft second end, wherein said crankshaft defines a crankshaft passage through said crankshaft from said crankshaft first end to said crankshaft second end;

injection means for providing fluid under pressure, from the source of pressurized fluid, into the crankshaft passage at the crankshaft first end, whereby fluid under pressure passes through said crankshaft passage and exits said crankshaft passage at said crankshaft second end; and distribution means connected to said crankshaft for directing the fluid exiting from said crankshaft passage at said crankshaft second end toward the durable surface.

2. Apparatus of claim 1, wherein said distribution means includes, at least, a distribution tube defining a tube cavity through said distribution tube, and wherein fluid exiting from said crankshaft passage at said crankshaft second end passes into said tube cavity.

3. Apparatus of claim 2, wherein said distribution means further includes, at least, a spray nozzle attached to said distribution tube, and wherein fluid flows from within said tube cavity through said spray nozzle toward the durable surface.

4. Apparatus of claim 3, wherein said distribution tube is rigidly connected to said crankshaft second end, wherein said crankshaft rotates to rotate said distribution tube, and wherein said spray nozzles are oriented such that fluid flowing from said spray nozzles toward said durable surface is propelled, due to said pressurization means, at least partially in the direction that the distribution tube rotates, whereby the rotation of said distribution tube increases the velocity at which the fluid is propelled from said distribution means toward the durable surface.

5. Apparatus of claim 2, wherein said distribution means further includes, at least, a plurality of spray nozzles attached to said distribution tube, and wherein fluid flows from within said tube cavity through said spray nozzles toward the durable surface.

6. Apparatus of claim 1, wherein said injection means includes, at least, a housing defining a housing cavity, wherein said housing cavity is in fluid communication with the source of pressurized fluid, wherein said housing is connected to said crankshaft first end, and wherein said housing cavity is in fluid communication with said crankshaft passage at said crankshaft first end.

7. Apparatus of claim 6, wherein said injection means further includes, at least, a bearing disposed between said housing and said crankshaft first end, wherein said bearing provides a substantially leak-tight connection between said crankshaft first end and said housing, and allows said crankshaft to rotate relative to said housing.

8. Apparatus of claim 1, wherein said pressure cleaning apparatus further comprises a wheeled chassis, and wherein said engine is mounted to said wheeled chassis.

9. Apparatus of claim 8, wherein said wheeled chassis includes, at least, a deck including, at least, a deck periphery, wherein said engine is mounted to said deck, wherein said crankshaft second end depends from said engine, passes through said deck, and is disposed below said deck, and wherein said distribution means is disposed below said deck;

a skirt depending from said deck periphery; and plurality of wheels for supporting said deck above and relative to the durable surface.

* * * * *